US005485259A

United States Patent [19]

Uehara et al.

[11] Patent Number: 5,485,259

[45] Date of Patent: Jan. 16, 1996

[54] FUSING DEVICE

[75] Inventors: Yasuhiro Uehara; Yasuhiro Kusumoto, both of Kanagawa, Japan

[73] Assignee: Fuji Xerox Co., Ltd., Tokyo, Japan

[21] Appl. No.: 276,329

[22] Filed: Jul. 18, 1994

[30] Foreign Application Priority Data

Jul. 19, 1993 [JP] Japan ..... 5-177742

[51] Int. Cl.[6] ..... G03G 15/20

[52] U.S. Cl. ..... 355/284; 355/282; 355/285; 355/290

[58] Field of Search ..... 355/282, 284, 355/285, 289, 290, 295; 219/216; 118/60

[56] References Cited

U.S. PATENT DOCUMENTS

| | | | |
|---|---|---|---|
| 4,047,885 | 9/1977 | Hauman, Jr. . | |
| 4,285,295 | 9/1979 | Iwao et al. | 118/60 |
| 4,375,505 | 3/1983 | Newkirk | 118/60 X |
| 4,910,559 | 3/1990 | Kuge et al. | 355/285 |
| 4,949,130 | 8/1990 | Torino | 355/282 |
| 5,123,151 | 6/1992 | Uehara et al. | 355/282 X |
| 5,200,786 | 4/1993 | Fromm et al. | 355/284 |
| 5,325,164 | 6/1994 | Tai et al. | 355/282 |
| 5,345,301 | 9/1994 | Satoh et al. | 355/290 |
| 5,371,571 | 12/1994 | Asanae | 355/285 X |

FOREIGN PATENT DOCUMENTS

| | | |
|---|---|---|
| 0291081 | 11/1988 | European Pat. Off. . |
| 57-205169 | 6/1956 | Japan . |
| 50-57444 | 5/1975 | Japan . |
| 50-106644 | 8/1975 | Japan . |
| 50-134655 | 10/1975 | Japan . |
| 57-20633 | 4/1982 | Japan . |
| 59-68766 | 4/1984 | Japan . |
| 60-8966 | 1/1985 | Japan . |
| 60-33362 | 3/1985 | Japan . |
| 60-104977 | 6/1985 | Japan . |
| 60-238879 | 11/1985 | Japan . |
| 61-4090 | 1/1986 | Japan . |
| 61-11773 | 1/1986 | Japan . |
| 61-40196 | 2/1986 | Japan . |
| 62-135865 | 6/1987 | Japan . |
| 62-166379 | 7/1987 | Japan . |
| 63-62861 | 4/1988 | Japan . |
| 63-62862 | 4/1988 | Japan . |
| 4-238095 | 8/1992 | Japan . |
| 4-52770 | 12/1992 | Japan . |
| 5-17662 | 3/1993 | Japan . |

*Primary Examiner*—Sandra L. Brase
*Attorney, Agent, or Firm*—Finnegan, Henderson, Farabow, Garrett & Dunner

[57] ABSTRACT

A fusing device for fusing a toner image by passing a recording sheet carrying an unfused toner image by means of the torque of a heating roll through a nip portion between the rotating heating roll and a heat-resistant solid elastic member which is forced to contact the outer peripheral surface of the heating roll to form the nip portion. In the fusing device, the heat-resistant solid elastic member includes an elastic body penetrated with a liquid release agent, and a lease-agent penetration control film whose region which is used for covering the surface of the elastic body and corresponds to at least the nip portion is formed of a porous film.

20 Claims, 2 Drawing Sheets

FUSING DEVICE

BACKGROUND OF THE INVENTION

1. Field of the Invention

The present invention relates to a fusing device for use in equipment such as copying machines, facsimiles, printers and the like making use of electrophotographic processing.

2. Description of the Related Art

In copying machines utilizing electrophotographic processing, unfused toner images formed on recording sheets have to be fused to change them into permanent images and a heat-fusing method for fusion-bonding the toner image on a recording sheet by heat-fusing toner powder is widely in use now.

As a heat-fusing device, there is a known device including a heating roll having a heater in a cylindrical core bar and a heat-resistant plastic layer formed on the outer peripheral surface of the core bar, and a pressure roll which is forced to contact the heating roll anti has a heat-resistant elastic layer formed on the outer peripheral surface of a cylindrical core bar. The device of the aforesaid heating roll type is used for fusing by passing a recording sheet carrying an unfused toner image through the nip portion between both rolls.

However, such a fusing device of the heating roll type requires the heating roll and when the heating roll is manufactured, expensive heat-resistant elastic material such as silicone rubber, fluororubber or the like is used to form the heat-resistant elastic layer. The problem is that equipment cost is relatively high. Moreover, the contact (nip portion) between the heat and pressure rolls ought to be at least 4 to 10 mm wide to secure predetermined fusing conditions. Consequently, it is necessary to set the roll diameter on the large size or provide a loading mechanism for applying a heavy load, for example, and the heat and pressure rolls are hardly made compact; this naturally results in large-sized and complicated devices.

In order to solve the problems peculiar to the aforesaid heating roll type fusing device, there has been proposed a fusing device to which, in place of a pressure roll, a heat-resistant solid elastic member is applied, the elastic member semicircular in cross section being forced to contact a heating roll (Japanese Utility Model Unexamined Publication No. Sho. 63-62861) . This fusing device is advantageous in that a reduction in not only manufacturing cost but also equipment size is feasible because the pressure roll can be dispensed with.

Notwithstanding, even the fusing device thus proposed still leaves room for improvement in order to deal with various demands growing every year for a reduction in equipment size and cost, and for an increase in performance and so on.

SUMMARY OF THE INVENTION

An object of the present invention is to provide a fusing device as what is of such a type as to employ a heat-resistant solid elastic member in place of a pressure roll, so that the size and cost of the device are made reducible without spoiling excellent stable fusing performance.

In order to attain the above object, the invention provides a fusing device for fusing a toner image by passing a recording sheet carrying an unfused toner image by means of a torque of a heating roll through a nip portion between the rotating heating roll and a heat-resistant solid elastic member which is forced to contact an outer peripheral surface of the heating roll to form the nip portion, the heat-resistant solid elastic member including: an elastic body penetrated with a liquid release agent; and a release-agent penetration control film formed of a porous film having a region which covers a surface of the elastic body and corresponds to at least the nip portion.

BRIEF DESCRIPTION OF THE DRAWINGS

The accompanying drawings, which are incorporated in and constitute a part of this specification, illustrate embodiments of the invention and, together with the description, serve to explain the objects, advantages and principles of the invention. In the drawings.

DETAILED DESCRIPTION OF THE PREFERRED EMBODIMENTS

Figure 1:
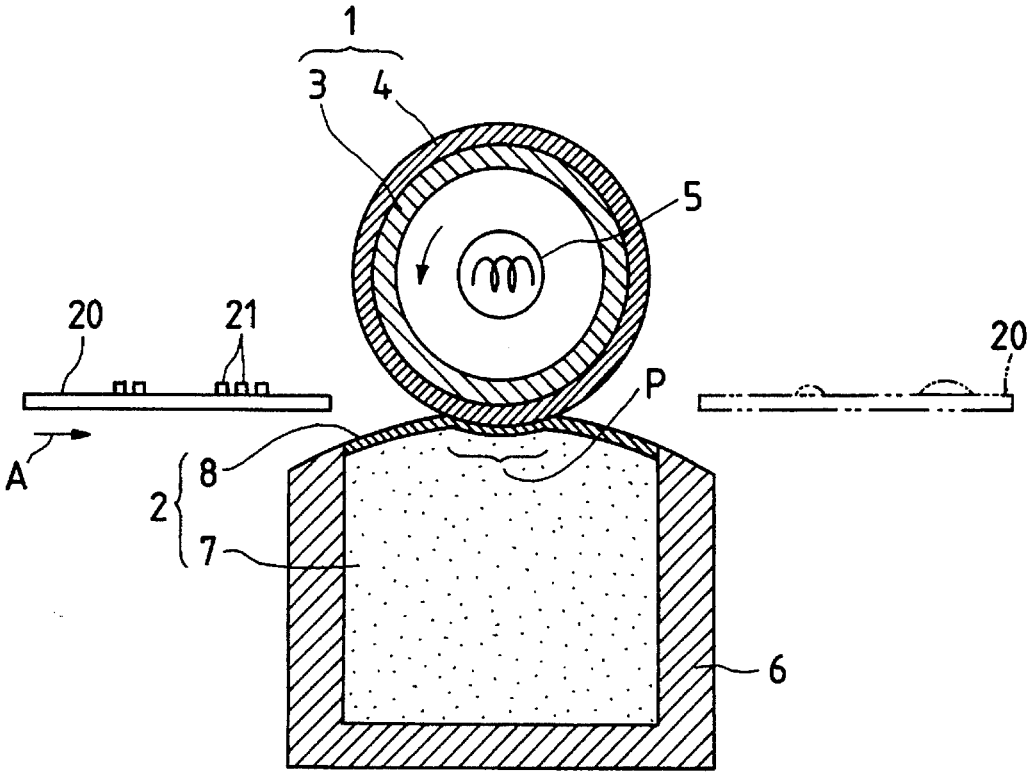
FIG. 1 is a schematic sectional view showing a fusing device according to an embodiment of the present invention.

A fusing device of the invention for fusing a toner image by passing a recording sheet carrying an unfused toner image by means of the torque of a heating roll through a nip portion between the rotating heating roll and a heat-resistant solid elastic member which is forced to contact an outer peripheral surface of the heating roll to form the nip portion is characterized in that the heat-resistant solid elastic member includes an elastic body penetrated with a liquid release agent, and a release-agent penetration control film formed of a porous film having a region which covers the surface of the elastic body and corresponds to at least the nip portion.

As a support body for holding the heat-resistant solid elastic member, use can be made of a sheet metal, a die-cast metal, a plastic material or the like. The support body itself may be either rigid body or what is elastic like a spring member. The heat-resistant solid elastic member cooperates with the support body in forming an elastic press member, which may have a convex profile with respect to the heating roll or a concave profile along the peripheral surface of the heating roll; in other words, it is important for the press member to form a nip portion necessary for fusing when it is forced to contact the heating roll. In order to reduce the size and power consumption of the fusing device effectively, the diameter of the heating roll is desired to be made as small as possible, whereas the minimum fusing temperature (approximately 120° C. to 140° C.) required for the fusing of toner powder must be secured. With the surface temperature of the heating roll set at about 130° C., for example, the necessary nip width ranges from 2 mm to 8 mm when ordinary toner images are fused at a rate of 4 cpm to 8 cpm (copy per minute). In order to keep the surface of the heating roll at 130° C., the diameter of the heating roll should preferably be set not greater than five times the nip width when a low power consumption heating device such as a Coltz lamp of 500 W or less is used and should preferably be set not less than 2.5 times when the heating device is held inside.

In the fusing device, the elastic body which forms the heat-resistant solid elastic member may be an elastic body which can be penetrated with the liquid release agent and also gives pressure necessary for fusing when the elastic member is forced to contact the heating roll. A porous or foamed body may be used as the elastic material and this is also the case with rubber material exemplarily shown in, for example, Japanese Utility Model Unexamined Publication No. Sho. 63-82861.

The release-agent penetration control film forming the heat-resistant solid elastic member is intended to properly regulate the supply of the release agent with which the elastic body is penetrated to the nip portion when the nip portion is formed by joining the heat-resistant solid elastic member and the heating roll together by pressing. It is therefore only necessary for the film to be able to supply the appropriate quantity of the release agent to the nip portion. Such a film may be formed of an elongated porous polytetrafluoroethylene film (Goatex GT Sheet manufactured by Japan Goatex Co., Ltd.) which is 3 to 100 μm thick, with a pore diameter of 0.1 to 100 μm and a pore percentage of 30 to 95%, a film member prepared by boring extra-fine holes or slits of 50 μm to 2.0 mm in diameter in a region of a fluorofilm 5 to 500 μm thick corresponding to the nip portion, or a composite film member prepared by bonding the above film member and a porous film (including unwoven fabric, paper, etc.) together.

In the invention, the means of supplying the release agent, that is, silicone oil, is commonly used as a nip-forming member for fusing. With this arrangement, off-setting on the heating roll and paper is prevented. On the assumption that toner offsetting on the heating roll occurs, the offsetting on the heating roll turns round once and runs into the nip portion before remaining in the neighborhood of the entrance of the fusing nip portion. As the neighborhood of the entrance of the fusing nip portion corresponds to the end at which fusing paper is caused to run in, offset toner remaining at the fusing nip portion is discharged together with the paper each time a copy is made and the offset toner is prevented from remaining on the peripheral surface of the heating roll. When a member for supplying silicone oil is provided separately from the fusing nip portion, on the other hand, the offset toner produced on the heating roll is accumulated in the region of the supply member to form a lump of offset toner. The offset toner is released sometimes and causes a large offset image to be generated on the copying paper.

Further, the fusing device according to the present invention is characterized by the provision of the aforesaid heat-resistant solid elastic member in such a way that the center line of the solid elastic member in its width direction intersects the rotary shaft of the heating roll.

If the solid elastic member is not made to intersect the heating roll but forced to contact the latter in parallel, the heating roll will bend because of the load applied thereto to obtain pressure necessary for fusing, thus resulting in letting the nip width decrease toward its central part from both end portions; in other words, the former is made to intersect the latter only to prevent the overall nip width from becoming uneven. The nip width is uniformized and this makes it possible to effect heat-fusing and to supply the release agent uniformly. Moreover, the uniform nip width is obtainable even though use is made of, for example, a small diameter heating roll which is less rigid and flexible.

In the conventional roll fusing method in which the pressure roll is forced to contact the heating roll, the means of arranging both rolls by intersecting them has been adopted. Since the directions in which a recording sheet is conveyed by the respective rolls are different to the extent that they intersect each other, there arises the problem of causing the sheet to become crumpled or a toner image to deviate unless the angle of intersection is minimized (the actual angle of intersection substantially ranges from 0.1° to 1.0°). On the contrary, no such a problem develops in the device according to the present invention because the recording sheet is conveyed only by the heating roll.

The fusing device according to the present invention is characterized in that the angle of intersection between the center line in the width direction of the heat-resistant solid elastic member and the rotary shaft of the heating roll is in the range of 0.5° to 3.0°, preferably 0.5° to 2.0°.

If the angle of intersection exceeds 3.0°, the curling of the recording sheet increases.

Further, the fusing device according to the present invention is characterized in that a release layer made of silicone rubber or fluororubber is formed on the outer peripheral surface of the heating roll and that the surface of the heat-resistant solid elastic member on the side where it contacts the heating roll is configured so as to have a radius of curvature greater than the radius of the heating roll.

The aforesaid heating roll is equipped with a heater in a cylindrical core material and the release layer on its outer peripheral surface. As a release layer having excellent heat resistance and toner release properties, it is preferred to use a rubber layer made of HTV (High Temperature Vulcanization) silicone rubber, RTV (Room Temperature Vulcanization) silicone rubber, fluororubber or the like. Moreover, the necessity of making the heating roll hold and convey the recording sheet as the roll rotates results in setting the friction coefficient of the heating roll with respect to the recording sheet higher than that of the heat-resistant solid elastic member.

Moreover, it is preferred that the surface of the heat-resistant solid elastic member on the side where it contacts the heating roll is configured so as to have a radius of curvature greater than the radius of the heating roll, whereby not only the nip width but also a fusing rate can be increased, whereas the diameter of the heating roll becomes reducible. In the case of the conventional roll type fusing device, the nip width has been limited in size to 1/10 to 1/5 time the diameter of the heating roll; however, the present invention makes it substantially possible to double the value of the width thereof (1/5 to 1/2.5 time).

A heating roll having a diameter of as small as 10 to 20 mm can be used according to the present invention.

Therefore, the release properties of the recording sheet from the heating roll improves and a small-sized low-cost, quick-start device is simultaneously attainable as the diameter of its heating roll is reducible.

The provision of such a special release layer for the heating roll and that of a specific configuration for the contact surface of the solid elastic member ensure that the recording sheet peels off without sticking to the heating roll by its own firmness at the time of fusing, whereby a release mechanism placed around the heating roll found in any conventional apparatus can be dispensed with. The uniform supply of the release agent formed of solid elastic member needless to say contributes to providing the excellent release properties of the recording sheet. Further, the use of such a small-diameter heating roll also makes the release mechanism unnecessary since the self-release properties of the recording sheet are strengthened.

Further, the fusing device according to the present invention is characterized in that a protrusion is provided on the downstream side in the direction in which the sheet is conveyed in a region corresponding to the nip portion of the heat-resistant solid elastic member or otherwise the hardness of the elastic body on the downstream side in the direction in which the sheet is conveyed in the region corresponding to the nip portion of the heat-resistant solid elastic member is set greater than that of an elastic body in any other portion.

In the device according to the present invention, the load applied to the heating roll can be set as low as approximately 2/1 to 1/10 of the total load 20 to 200 kg in the conventional device, whereby pressure (0.5 to 5.0 kg/cm$^2$) necessary for fusing is fully available. By providing the protrusion or increasing the hardness of the elastic body, pressure higher than that in any other portion is obtainable in a portion where the protrusion or the extra-hard elastic body exists. Thus the load applied to the heating roll becomes reducible further since pressure necessary for fusing is available only in a portion where the protrusion exists or at the extra-hard elastic body.

Therefore, the configuration and hardness of the protrusion and the extra-hard elastic body are not restrictive as long as the pressure needed for fusing is obtainable.

Further, the fusing device according to the present invention is characterized in that a temperature sensor for regulating the temperature of the heating roll is provided on the upstream side in the direction in which the sheet is conveyed in the region corresponding to the nip portion of heat-resistant solid elastic member.

The temperature sensor may be provided between the elastic body in the region of the nip portion of the heat-resistant solid elastic member and the film. Moreover, a temperature detection signal from the sensor is fed back to, for example, a heating temperature control circuit of the heating roll.

In the fusing device according to the present invention, the nip portion is formed by the heat-resistant solid elastic member in cooperation with the heating roll, and the elastic member also functions as a release agent supplier. Moreover, the uniform nip width is made obtainable by properly intersecting the heat-resistant solid elastic member and the heating roll and joining them together by pressing.

Consequently, the release agent supplier placed around the heating roll in the conventional apparatus can be dispensed with and a small-sized low cost apparatus is thus attainable. Since the proper quantity of the release agent is supplied from the nip portion having uniform width, the recording sheet is allowed to peel off the heating roll smoothly and the release mechanism disposed around the heating roll can also be dispensed with. Further, ordinary toner powder may be used by supplying the release agent at a ratio of 0.1 to 2.0 mg/copy without using wax-containing oilless toner which is normally used for small-sized copying machines very often.

Incidentally, toner powder can efficiently be heated and fused to effect excellent fixation in the device according to the present invention since the unfused toner-image carrying side of the recording sheet is caused to face the heating roll at the time of fusing.

The heating roll is provided with the special release layer and the specific configuration (e.g., curved surface) for the contact surface of the heat-resistant solid elastic member is provided so as to improve the release properties of the recording sheet from the heating roll. Therefore, the release mechanism can be dispensed with to ensure that the device is made small-sized and less costly.

The omission of the release mechanism like this not only obviates the possibility of letting such a mechanism interfere with the work of taking out the recording sheet jammed in the fusing device but also prevents the abrasion of the surface of the heating roll clue to release fingers and any accident arising when the worker happens to touch the release finger. Since only the heat-resistant solid elastic member is disposed around the heating roll, the construction of the device is considerably simplified. In addition, the heat of the heating roll is kept from being absorbed and accordingly being wasted by any other member in contact therewith as only the solid elastic member is allowed to contact the heating roll and this makes it possible to considerably shorten the time (warm-up time) required for the heating roll to rise up from the room temperature up to the temperature level at which fusing can be carried out.

The provision of the protrusion in a predetermined region of the heat-resistant solid elastic member or the use of the extra-hard elastic body makes obtainable a pressure higher than that in any other region at the time of fusing, so that the load applied to the heating roll becomes reducible.

Further, the installation of the temperature sensor for controlling the temperature of the heating roll in the region corresponding to the nip portion of the heat-resistant solid elastic member makes it possible to detect the nip portion heating temperature directly to ensure that the fusing temperature is set accurately as compared with the conventional device in which such a sensor is installed around the heating roll on this side of the nip portion. Since the release agent is always present at the interface between the temperature sensor and the heating roll, the surface of the heating roll is almost free from the damage caused by the sensor.

Figure 3:
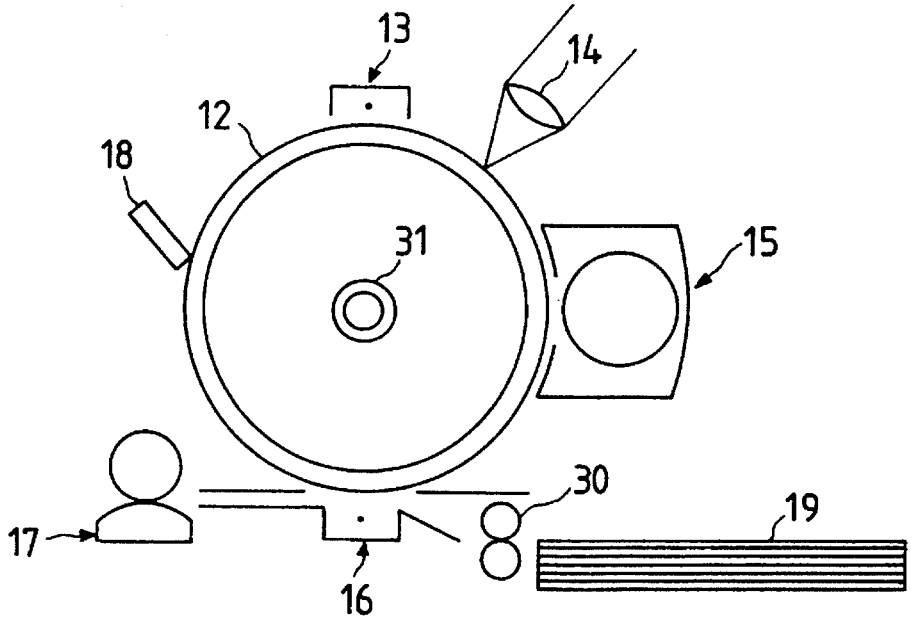
FIG. 3 is a schematic view showing a construction of an electrophotographic device using a fusing device of the present invention.

FIG. 3 shows a schematic construction of an electrophotographic device using a fusing device of the present invention. Reference numeral 12 designates a photoreceptor; 13, charging means for uniformly charging the photoreceptor in a dark place; 14, latent image forming means for forming a latent image in the photoreceptor by exposing the photoreceptor to an optical image corresponding to an original image; 15, developing means for developing the latent image into a visible image with toner powder; 16, transfer means for transferring the developed image onto a transfer member; 17, a fusing device according to the present invention; 18, cleaning means; 19, a transfer paper; 30, a sheet feed roller; and 31, a rod for rotating the photoreceptor in a direction.

Hereinafter, preferred embodiments of the present invention will be described.

FIG. 1 shows a fusing device according to an embodiment of the present invention, wherein reference numeral 1 designates a heating roll; 2, a heat-resistant solid elastic member forced to contact the heating roll 1; 20, a recording sheet; 21, unfused toner powder formed on the recording sheet 20; and reference symbol A, a direction in which the recording sheet is conveyed.

The heating roll 1 is prepared by dip-coating silicone RTV rubber on the outer peripheral surface of a cylindrical iron core member 3 which is 15 mm in outer diameter, 0.3 mm in wall thickness and 225 mm in roll length to form a release layer 4 which is 30 μm thick. An infrared lamp of output 100 V, 300 W is disposed as a heat source 5 in the hollow portion of the heating roll 1.

The heat-resistant solid elastic member 2 includes a silicone sponge 7 (rubber hardness: 35°±3°) (the value measured at a load of 300 g by a sponge rubber hardness meter of Ascar C type manufactured by High Polymer Science Co., Ltd.) accommodated in a support body 6 having an upper open part, and a porous tetrafluoroethylene film (20 μm thick, with a pore diameter of 0.1 to 2.5 μm and a pore percentage of 55%) as a release-agent penetration control film 8 coating the surface of the sponge 7 in contact with the heating roll 1.

The sponge 7 penetrated with 100 g of dimethyl silicone oil of 10000 centistoke as a release agent is set by the release-agent penetration control film 8 so that the supply of oil is set at 0.5 mg per A4-size sheet. While oil was being supplied, it was found that a static friction coefficient with respect to a recording sheet (ordinary A4 L paper manufactured by Fuji Xerox Co., Ltd.) on the heating roll 1 was 0.68 on one hand, and a static friction coefficient with respect to the recording sheet on the solid elastic member 6 was 0.12 on the other.

The solid elastic member 2 has a curved surface in contact with the heating roll 1, the surface having a radius of curvature of 60 mm, and the topmost portion thereof is 20 mm thick. The nip portion P formed by the solid elastic member 2 can be made as wide as 6 mm when a load of 8 kg is applied even by a small-diameter heating roll.

Figure 2:
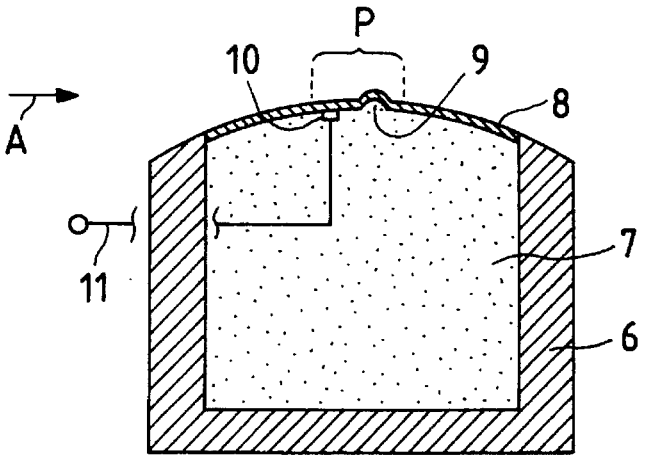
FIG. 2 is a structural sectional view showing a heat-resistant solid elastic member in the fusing device of FIG. 1.

As shown in FIG. 2, a protrusion 9 (1 mm high and 1 mm wide) semicircular in cross section is further provided in parallel to the axial direction of the heating roll 1 on the downstream side in the direction in which the sheet is conveyed at the nip portion P of the solid elastic member 2 so as to acquire a greater pressure effect at a small load. As the protrusion 9 is pressed down when the heating roll 1 is forced to contact it, a pressure greater than that in any other region is locally obtained in the region of the nip portion where the protrusion 9 exists.

A thermistor as a temperature sensor 10 is installed between the elastic body 7 and the film 8 of the solid elastic member 2 corresponding to the nip portion on the upstream side in the direction in which the sheet is conveyed in the nip portion P of the solid elastic member 2. Further, the temperature detection signal from the sensor 10 is applied via a connection line 11 to a temperature control circuit (not shown) for the heating roll.

With the fusing device thus constructed, the experiments were made as follows:

While an angle of intersection between the heating roll 1 and the heat-resistant solid elastic member 2 was multifariously varied, both of them were joined together by pressing (with a load of 5 kg) and the nip widths in the central part and at both ends were measured. Table 1 shows the measured results.

TABLE 1

| Angle of intersection (°) | 0 | 1.0 | 2.0 | 3.0 |
|---|---|---|---|---|
| Central nip width (mm) | 3.0 | 4.0 | 5.0 | 6.0 |
| Nip width at both ends (mm) | 6.0 | 5.5 | 5.0 | 4.0 |

From the results shown in Table 1, the central nip width was seen to grow gradually as the angle of intersection was increased and became substantially uniform at an angle of 2.0°.

Subsequently, the angle of intersection in the fusing device was set at 2.0° and the supply of a release agent was so regulated that it was supplied at 0.2 mg per recording sheet. Then, toner powder (for Vivace 200 manufactured by Fuji Xerox Co., Ltd.) was applied (a coverage of 0.1/cm$^2$) to the whole surface of each recording sheet weighing as shown in Table 2. Then, recording sheets carrying such toner powder were fed to examine their self-release properties. Further, the diameter of the heating roll was varied as shown in Table 2, which shows the results of experiments.

In Table 2, vertical feed refers to a case where the recording sheet is conveyed in parallel to a direction of paper fibers, whereas horizontal feed refers to a case where the recording sheet is conveyed in a direction perpendicular to that of the paper fibers. The self-release properties of recording sheets were evaluated with the following criteria: o . . . the recording sheet peeled off without sticking to the heating roll; and x . . . it was sticking to the heating roll and did not peel off.

For the purpose of comparison, only the silicone RTV layer as the release layer of the heating roll was replaced with a polytetrafluoroethylene resin (trade name: Teflon) layer and the self-release properties of recording sheets were examined. Table 2 also shows the results of these experiments.

TABLE 2

| | Recording sheet | | | | | | Heating roll |
|---|---|---|---|---|---|---|---|
| | Weighing (55 kg/m$^2$) | | Weighing (64 kg/m$^2$) | | Weighing (76 kg/m$^2$) | | |
| | Vertical feed | Horizontal feed | Vertical feed | Horizontal feed | Vertical feed | Horizontal feed | diameter (mm) |
| Embodiment | o | o | o | o | o | o | 10 |
| Comparative example | o | o | o | o | o | o | |
| Embodiment | o | o | o | o | o | o | 15 |
| Comparative example | o | x | o | x | o | o | |
| Embodiment | o | x | o | o | o | o | 20 |
| Comparative example | o | x | o | x | o | o | |

As is obvious from Table 2, the recording sheet smoothly peels off the heating roll when the fusing device according to the embodiment (with the silicone RTV layer as a release layer) employs a heating roll of 15 mm in diameter, whereas the recording sheet tends to coil round the heating roll as it weights less in the comparative examples (with the polytetrafluoroethylene resin layer as a release layer) of the fusing device.

In view of this, the silicone RTV layer as a release layer of the heating roll is superior in release properties and the recording sheet peels off without coiling round the heating roll in the worst condition in which the toner powder is sticking to the whole surface of the recording sheet; this fact again proves that the release mechanism can be dispensed with. In the case of any comparative example, the friction coefficient of the heating roll (actually, the upper release layer thereof) with respect to the recording sheet ranges from 0.1 to 0.2. The problem is that the conveyance of the recording sheet remains unstable and that the recording sheet may become impossible to be conveyed from time to time.

The smaller the diameter of the heating roll, the more the release properties of the recording sheet improves. This also proves that the release mechanism can be dispensed with.

In the case of the fusing device according to the present embodiment, it was confirmed that the heating roll was free from abrasion and damage caused by the temperature sensor even at a point of time fusing had been carried out 100,000 times for copying.

Figure 4:
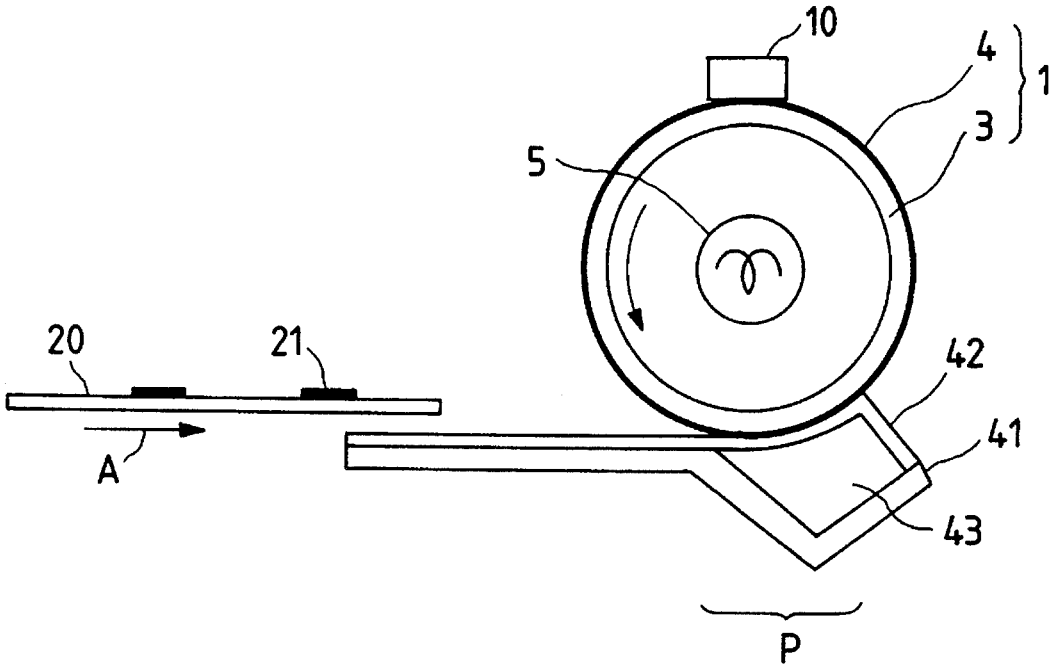
FIG. 4 is a schematic view showing a fusing device according to another embodiment of the present invention.

Referring to FIG. 4, a description will subsequently be given of another embodiment of the present invention, wherein like reference numerals or characters designate like members according to the above-described embodiment of the invention.

Reference numeral 41 designates a support body for supporting a heat-resistant elastic member, the support body being formed of a brass metal plate having elasticity or made of heat-resistant plastic material. The left end of the support body is secured with a fitting member (not shown) to the apparatus body, whereas the right end thereof is forced to contact the heating roll under a pressure of 0.5 to 5 kg/cm$^2$ so as to form a nip portion P. The right end of the support body is bent into a L-shape to provide the metal plate with a desired hardness. A heat-resistant elastic member 43 is secured to the L-shaped recess. The heat-resistant elastic member may be such that its portion in contact with the heating roll is formed along the surface profile of the heating roll or formed linearly. However, the fusing nip portion thus formed needs to have a predetermined width along the surface profile of the heating roll when the elastic member at least makes contact with the heating roll under a predetermined pressure. The width of the fusing nip portion is set at 2 mm to 8 mm and preferably 3 mm to 6 mm, though it depends on the surface temperature of the roll and the number of copies to be made.

As in the case of the above-described first embodiment of the invention, the heat-resistant elastic member is made of the same material and contains a release agent such as silicone oil. The supply of the release agent is kept constant by a release-agent penetration control film 42 put on the heat-resistant elastic member. The release-agent penetration control film 42 is provided in a part of the nip portion P and the remaining part may be formed with a release-agent non-penetrable film material, ordinary fluororesin, fluororubber or the like. In addition, a temperature sensor 10 is installed in contact with the heating roll 1 in this embodiment.

In order to deal with the release operation when the fusing device is jammed with paper, the support body 41 may detachably be installed opposite to the heating roll 1 while the heating roll is rotatably secured to the apparatus body or the relation between the support body and the heating roll may be reversed. The former arrangement is preferred when workability and stability are taken into consideration. With the left end of the support body as a hinge, the support body may be supported rotatably in this case.

In the formation of a nip portion by rolls in the conventional way, pressure is high at both ends of each roll and low in the central part thereof due to the stress of the roll when the pressure is applied to them so as to supply a predetermined fusing pressure to the nip portion. Consequently, it is needed to intersect both rolls or apply a heavy load to them; this restricts the roll diameter, thus impeding size reduction. However, the stress on the side of the heating roll is made absorbable by making the other side a plate-like body, so that the roll size becomes reducible as a high nip pressure is obtainable with a light load.

As set forth above, the uniform nip width can be secured according to the present invention. Since the proper quantity of the release agent is always supplied from the heat-resistant solid elastic member to the nip portion, uniform and smooth fusing can be carried out.

The release agent supplier and the release mechanism disposed around the heating roll in the conventional device can be dispensed with. Moreover, it is possible to considerably reduce the size and cost of a fusing device as a small-sized heating roll is attainable.

What is claimed is:

1. A fusing device for fusing a toner image by passing a recording sheet carrying an unfused toner image by means of torque from a rotating heating roll through a nip portion between the rotating heating roll and a curved surface of a substantially stationary heat-resistant solid elastic member which is forced to contact an outer peripheral surface of the heating roll to form a nip portion, said heat-resistant solid elastic member comprising:

an elastic body penetrated with a liquid release agent; and a release-agent penetration control film formed of a porous film having a region which covers a surface of said elastic body and corresponds to at least the nip portion.

2. The fusing device as claimed in claim 1, wherein said heat-resistant solid elastic member is installed in such a way that a center line of said elastic member in its width direction intersects a rotary shaft of the heating roll.

3. The fusing device as claimed in claim 1, wherein a release layer made of silicone rubber or fluororubber is formed on the outer peripheral surface of the heating roll and wherein a surface of said heat-resistant solid elastic member on the side where it contacts the heating roll is configured so as to have a radius of curvature greater than a radius of the heating roll.

4. The fusing device as claimed in claim 1, wherein said heating roll has a diameter in the range of 10 to 20 mm.

5. The fusing device as claimed in claim 1, wherein a protrusion is provided on the downstream side in a direction in which the sheet is conveyed in a region corresponding to the nip portion of said heat-resistant solid elastic member.

6. The fusing device as claimed in claim 1, wherein a temperature sensor for regulating a temperature of said heating roll is provided on the upstream side in a direction in which the sheet is conveyed in a region corresponding to the nip portion of said heat-resistant solid elastic member.

7. A fusing device for fusing a toner image by passing a recording sheet carrying an unfused toner image by means of torque from a heating roll through a nip portion between the rotating heating roll and a heat-resistant solid elastic member which is forced to contact an outer peripheral surface of the heating roll to form a nip portion, said heat-resistant solid elastic member having a center line in its width direction intersecting the center line of the heating roll at an angle of intersection, wherein the angle of intersection is in the range of 0.5 to 3.0°, said heat-resistant solid elastic member comprising:

an elastic body penetrated with a liquid release agent; and a release-agent penetration control film formed of a porous film having a region covering at least the nip portion of the surface of said elastic body.

8. A fusing device for fusing a toner image by passing a recording sheet carrying an unfused toner image by means of torque from a heating roll through a nip portion between the rotating heating roll and a heat-resistant solid elastic member which is forced to contact an outer peripheral surface of the heating roll to form a nip portion, said heat-resistant solid elastic member comprising:

an elastic body penetrated with a liquid release agent the hardness of said elastic body on the downstream side in a direction in which the sheet is conveyed in a region corresponding to the nip portion of said heat-resistant solid elastic member being greater than that of an elastic body in any other portion/and a release-agent penetration control film formed of a porous film having a region which covers at least the nip portion of the surface of said elastic body.

9. A fusing device comprising:

a heating roll containing a heat source; and an elastic press member for forming a nip portion for fusing as what is forced to contact said heating roll, said elastic press member including a support body, an elastic body provided with the support body, a release agent provided in the elastic body, and a control member which is provided in the nip portion and used for controlling the supply of the release agent to the nip portion.

10. The fusing device as claimed in claim 9, wherein a width of the nip portion is in the range of 2 mm to 8 mm.

11. The fusing device as claimed in claim 10, where a diameter of said heating roll is in the range of 5 to 2.5 times the width of the nip portion.

12. The fusing device as claimed in claim 9, wherein a pressure in the nip portion is in the range of 0.5 to 5.0 $kg/cm^2$.

13. The fusing device as claimed in claim 9, wherein said press member has a radius of curvature greater than that of said heating roll in the nip portion.

14. The fusing device as claimed in claim 9, wherein said press member has a protrusion in the nip portion.

15. The fusing device as claimed in claim 9, wherein said press member has an extra-hard portion in the nip portion.

16. The fusing device as claimed in claim 9, wherein said heating roll and said press member have a predetermined angle of intersection.

17. The fusing device as claimed in claim 9, wherein a supply of the release agent is controlled by the control member in the range of 0.1 to 2.0 mg/copy.

18. The fusing device as claimed in claim 9, wherein the press member has a profile following an outer peripheral surface of said heating roll.

19. An image forming apparatus comprising:

an image forming unit; and an image fusing unit, said image fusing unit comprising a fusing device comprising:

a heating roll containing a heat source; and an elastic press member for forming a nip portion for fusing as what is forced to contact said heating roll, said elastic press member including a support body, an elastic body provided with the support body, a release agent provided in the elastic body, and a control member which is provided in the nip portion and used for controlling the supply of the release agent to the nip portion.

20. The image forming apparatus as claimed in claim 19, wherein a quantity of the release agent stored therein corresponds to the life of said fusing device or image forming apparatus.

* * * * *

UNITED STATES PATENT AND TRADEMARK OFFICE

CERTIFICATE OF CORRECTION

PATENT NO. : 5,485,259

DATED : January 16, 1996

INVENTOR(S) : Yasuhiro UEHARA et al.

It is certified that error appears in the above-indentified patent and that said Letters Patent is hereby corrected as shown below:

Claim 8, column 11, line 16, after "agent" insert --,--.

Claim 8, column 11, line 21, change "/" to --;--.

Signed and Sealed this

Twenty-second Day of October, 1996

*Attest:*

Bruce Lehman

BRUCE LEHMAN

*Attesting Officer*

*Commissioner of Patents and Trademarks*